US009259091B2

(12) United States Patent
Freund

(10) Patent No.: US 9,259,091 B2
(45) Date of Patent: Feb. 16, 2016

(54) RECLINER AND TRAVEL PILLOW

(71) Applicant: Andrea Vanessa Freund, Gerrardstown, WV (US)

(72) Inventor: Andrea Vanessa Freund, Gerrardstown, WV (US)

( * ) Notice: Subject to any disclaimer, the term of this patent is extended or adjusted under 35 U.S.C. 154(b) by 0 days.

(21) Appl. No.: 13/937,760

(22) Filed: Jul. 9, 2013

(65) Prior Publication Data

US 2015/0013071 A1 Jan. 15, 2015

(51) Int. Cl.
*A47G 9/00* (2006.01)
*A47C 7/38* (2006.01)

(52) U.S. Cl.
CPC ..... *A47C 7/383* (2013.01)

(58) Field of Classification Search
CPC ..... A47G 9/00
USPC ..... 5/636, 640, 648, 655.3, 657
See application file for complete search history.

(56) References Cited

U.S. PATENT DOCUMENTS

| | | | | | |
|---|---|---|---|---|---|
| 5,168,590 | A * | 12/1992 | O'Sullivan | ..... | 5/490 |
| 5,193,238 | A * | 3/1993 | Clute | ..... | 5/655 |
| 5,272,780 | A * | 12/1993 | Clute | ..... | 5/655 |
| 5,367,730 | A * | 11/1994 | Sher | ..... | 5/655 |
| 5,499,418 | A * | 3/1996 | Tan et al. | ..... | 5/655 |
| 5,581,832 | A * | 12/1996 | Bridley | ..... | 5/655 |
| 5,864,904 | A * | 2/1999 | Rudick | ..... | 5/640 |
| 6,631,528 | B2 * | 10/2003 | Landry | ..... | 5/494 |

* cited by examiner

*Primary Examiner* — Fredrick Conley
(74) *Attorney, Agent, or Firm* — Jason T. Daniel, Esq.; Daniel Law Offices, P.A.

(57) ABSTRACT

A recliner and travel pillow includes a main body having a flat central portion, a first pocket and a second pocket disposed along either side of the central portion, and a pair of pillow inserts having a size and dimension that is complementary to the first and second pockets. An adjustment unit is disposed along the flat central portion for adjusting a distance between the first and second pockets and a plurality of connectors are disposed within the first and second pockets, functioning to adjust a dimension of the pockets, and to secure the pockets in a closed position.

19 Claims, 8 Drawing Sheets

RECLINER AND TRAVEL PILLOW

TECHNICAL FIELD

The present invention relates generally to pillows, and more particularly to a pillow for use when a person is sitting upright, or in a high backed chair.

BACKGROUND

The statements in this section merely provide background information related to the present disclosure and may not constitute prior art.

Although conventional beds are the most common devices for facilitating sleep, millions of people sleep or otherwise rest in a recliner or high backed chair each day. In some instances, the individual has medical issues that require they remain in a generally upright position, while other times the individual is traveling by car, bus or plane, for example where it is not possible to lie down. The strain on the body caused by resting in such upright positions can lead to very serious health concerns, including head and neck misalignment.

For this reason, there are a number of known travel pillows that are designed to cradle the head and neck of the user when sitting in an upright position. These pillows typically include a generally U-shaped member having internally located padding with a uniform thickness throughout. To this end, these pillows are designed to be positioned behind the user's neck, and extend forward across the shoulders. Unfortunately, however this arrangement functions to actively push the head of a user away from the back of the chair in which they are sitting. When this occurs, the user must actively push their head or neck against the pillow, to maintain their head in a somewhat reclined position, thereby causing head and neck strain and potentially serious medical issues over time. Moreover, these devices are typically formed as a "one size fits all" which does not allow a user to customize either the shape or thickness of the pillow to their particular comfort.

Accordingly, it would be beneficial to provide a recliner and travel pillow that does not suffer from the drawbacks of the above noted devices.

SUMMARY OF THE INVENTION

The present invention is directed to a recliner and travel pillow. One embodiment of the present invention can include a main body having a flat central portion and a first pocket and a second pocket being disposed along either side of the central portion. The pillow can also include a pair of pillow inserts having a size and dimension that is complementary to the first and second pockets.

Another embodiment of the present invention can include an adjustment unit capable of adjusting a distance between the first and second pockets.

Yet another embodiment of the present invention can include a plurality of connectors disposed within the first and second pockets, these connectors can function to adjust a dimension of the pockets, and to secure the pockets in a closed position.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Figure 1:
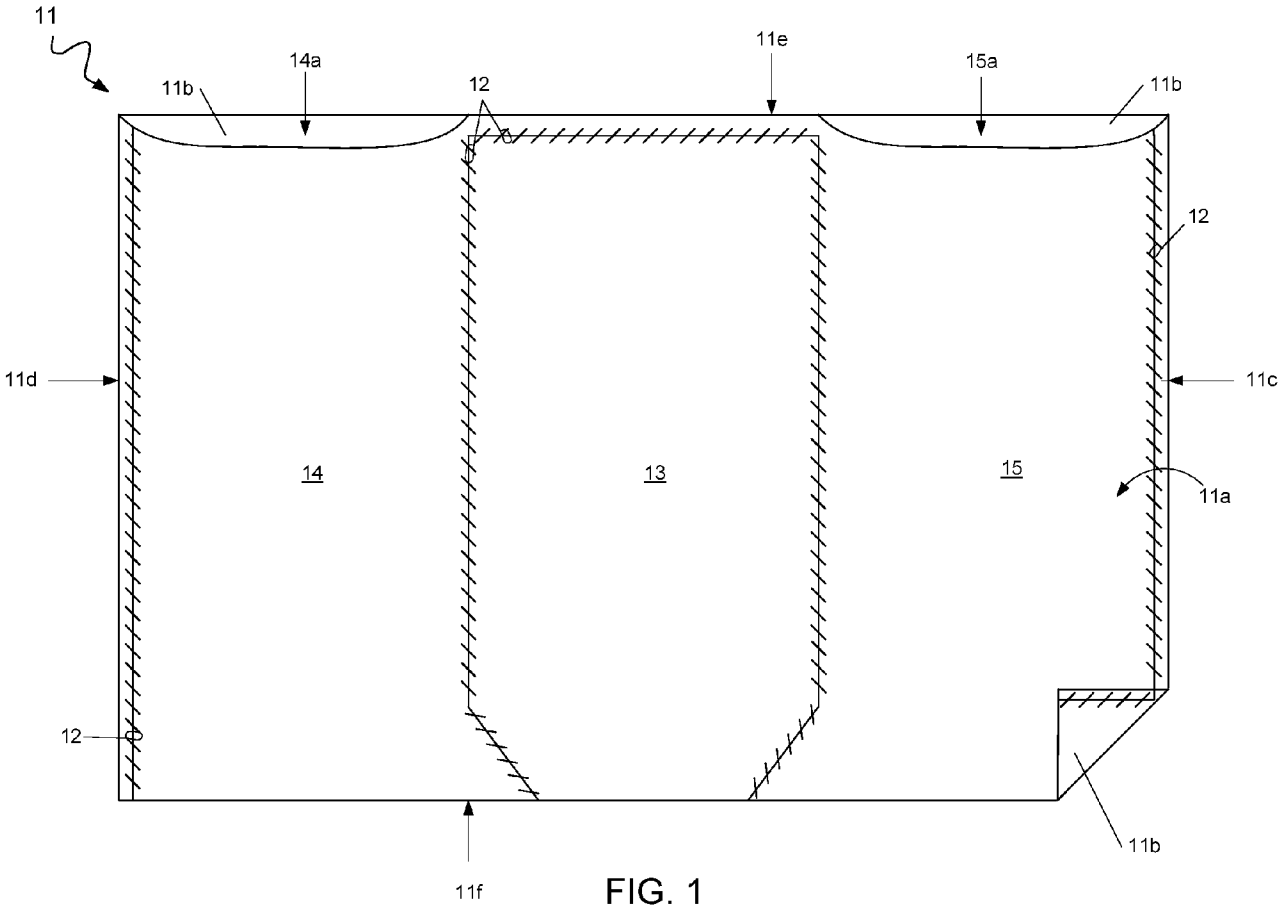
FIG. 1 is a top view of a main body in accordance with one embodiment of the invention.

For purposes of this description, the terms "upper," "bottom," "right," "left," "front," "vertical," "horizontal," and derivatives thereof shall relate to the invention as oriented in FIG. 1. The term "dimension" is used separate from the term "shape," to describe an overall size and/or volume of a particular portion of the pillow, and more specifically to define the space within the pockets available to receive a removable pillow insert.

As described throughout this disclosure, a recliner and travel pillow 10 can function to provide head and neck support to a user sitting in a high back chair, without pushing the users head forward. This is accomplished through the use of a multi-pocketed main body having a flat central portion and a pair of removable pillow inserts that are designed to be positioned along either side of the users head to provide full lateral support.

FIG. 1 illustrates one embodiment of the main body 11, which can function to receive a pair of removable pillow inserts 20 that will be described below. The main body 11 can include a front surface 11*a* and a rear surface 11*b* that are secured together along the outside edges 11*c* and 11*d* via conventional seams 12. As shown, the middle section of the main body 13 can be completely flat, and can be encompassed by additional seams located along the top edge 11*e*, and extending downward to the closed bottom edge 11*f*, thereby forming pockets 14 and 15, each having openings 14*a* and 15*a* respectively.

As described herein, the main body 11 can preferably be constructed from a soft material such as cotton, for example, which is a common and widely accepted material for pillows, clothing and other such items. Of course, any number of other fabrics such as wool, polyester, flannel, silk and/or satin, among many others for example, can also be utilized. As will be apparent to those of skill in the art, the main body can also include any number of different designs, markings, colors and other such indicia which would be pleasing to a user.

The seams 12 can include any number of conventional materials and manufacturing techniques such as stitching, hem tape and/or liquid seams, among many others for example. Each of these items being well and truly known in the art, no further description will be provided.

Although size is not critical, in one preferred embodiment, the main body 11 can include a length (edges 11*c* to 11*d*) of approximately 18 inches, a height (edges 11*e* to 11*f*) of approximately 11 inches, and a generally flat thickness (front surface 11*a* to back surface 11*b*) of between 1 and 10 millimeters. Likewise, pockets 14 and 15 can preferably include a length of approximately 6 inches, a height of approximately 11 inches, and a thickness of between approximately 5 and 10 millimeters without a pillow insert, and between approximately 1 and 4 inches when a pillow insert is positioned therein. However, it will be apparent to those skilled in the art that the exact dimensions of the pillow body 11 may vary from these amounts without departing from the overall spirit and scope of the present invention.

Figure 2:
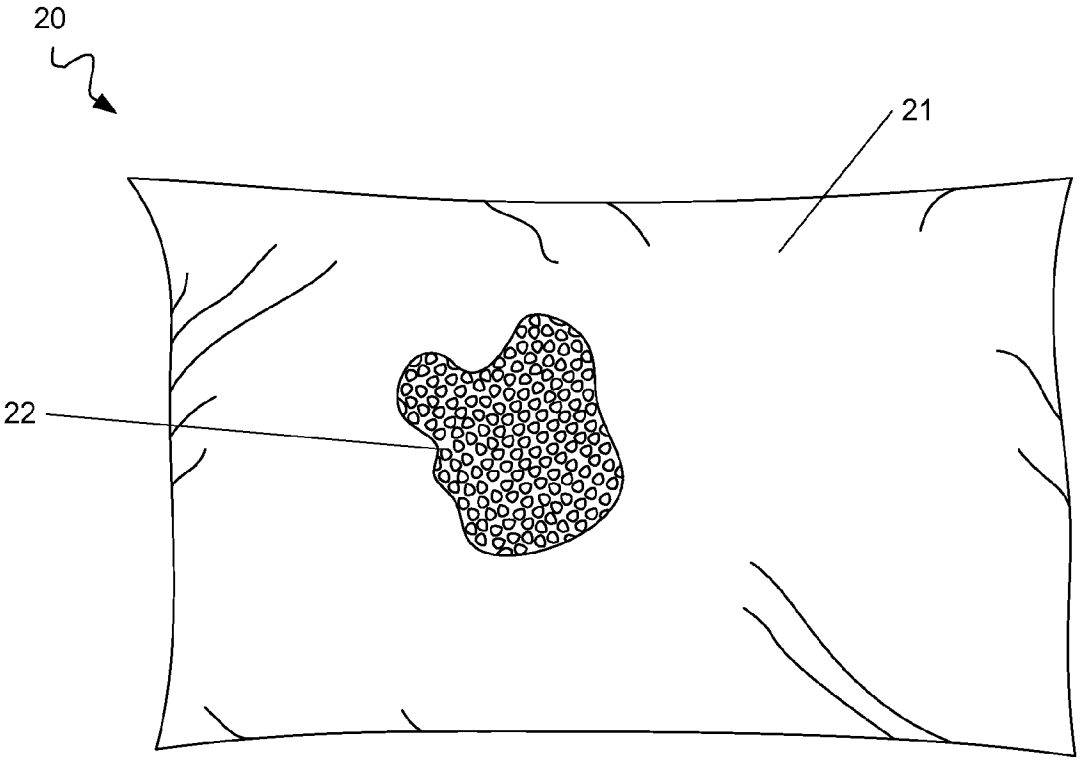
FIG. 2 is a perspective view of a pillow insert for use with the main body illustrated in FIG. 1.

FIG. 2 illustrates one embodiment of a suitable pillow insert 20 which can be utilized with the main body 11. As shown, the pillow insert can include an outer casing 21 having a shape and dimension that is complementary to the shape and dimension of at least one of the pockets 14 and 15 of the main body 11. The casing 21 can be constructed from any number of commonly utilized pillow materials, and can function to enclose a fill material 22 such as Styrofoam beads, or a washable fill material such as polyfill, foam, down and/or microfiber, for example, which can be removed from the main body and cleaned via a conventional washing machine. Additionally, pillow insert 20 can comprise an inflatable bladder, thereby creating an air pillow insert. The air pillow can be inflated and deflated by a user via a conventional air valve (not shown).

Figure 3A:
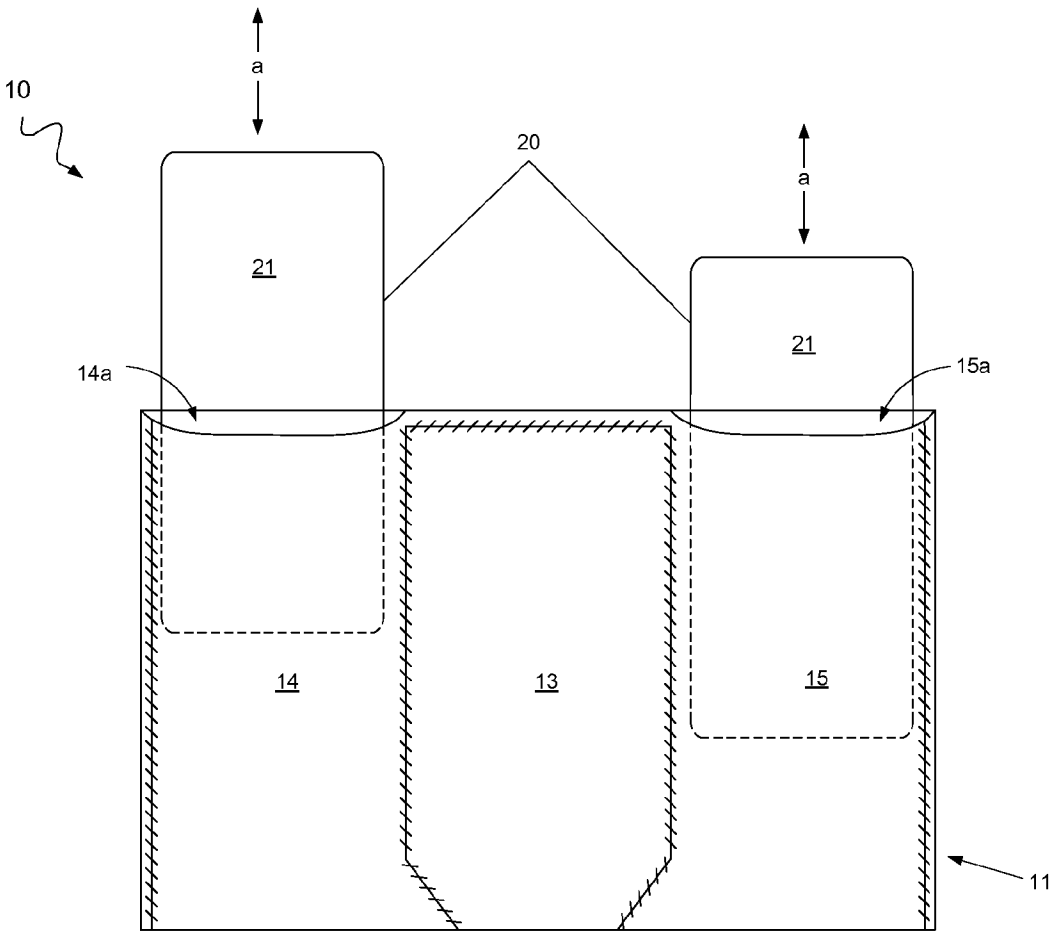
FIG. 3*a* is a front side view of the recliner and travel pillow in operation, in accordance with one embodiment of the present invention.
Figure 3B:
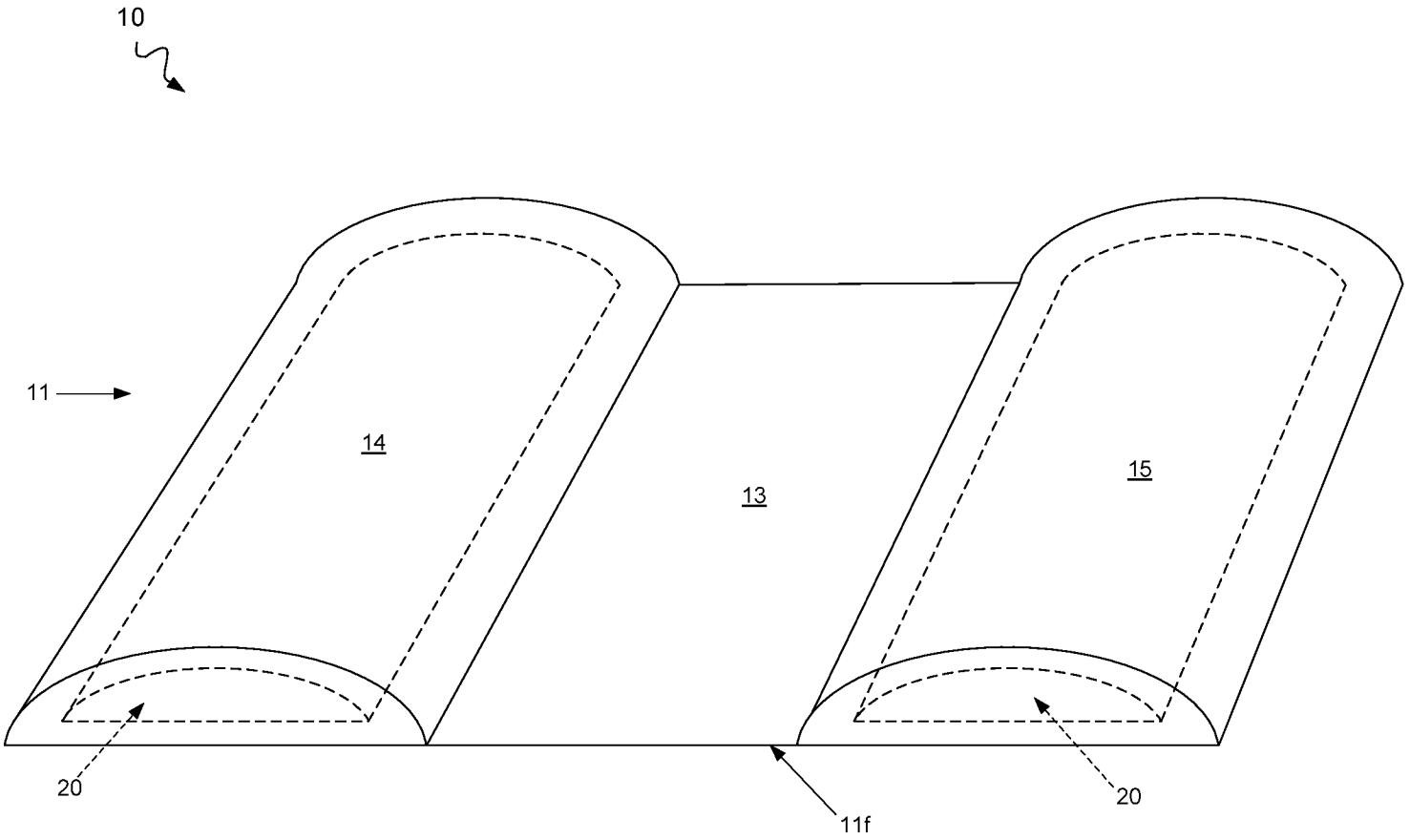
FIG. 3*b* is a perspective view of the recliner and travel pillow, in accordance with one embodiment of the present invention.
Figure 3C:
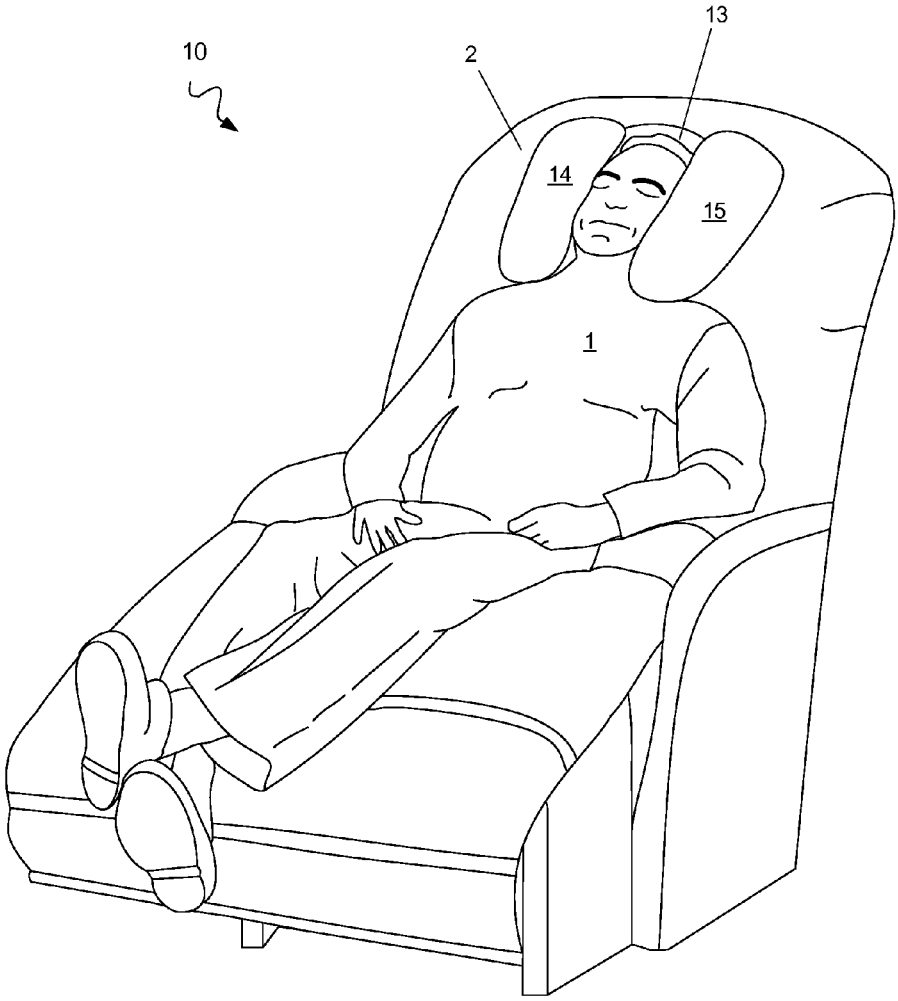
FIG. 3*c* is a perspective view of the recliner and travel pillow in use, in accordance with one embodiment of the present invention.

As shown in FIGS. 3A-3C, a pair of the pillow inserts 20 can be removably inserted (See arrow A) through openings 14*a* and 15*a*, so as to be retained within the pockets 14 and 15 of the main body 11. When so positioned, the pockets 14 and 15 can protrude outward from the main body, while middle section 13 remains flat. In operation, when a user 1 rests their head on the flat portion 13, the outward protruding side portions 14 and 15 are positioned along the entirety of the users head and neck to provide complete lateral support, without pushing the users head away from the chair 2.

Figure 4:
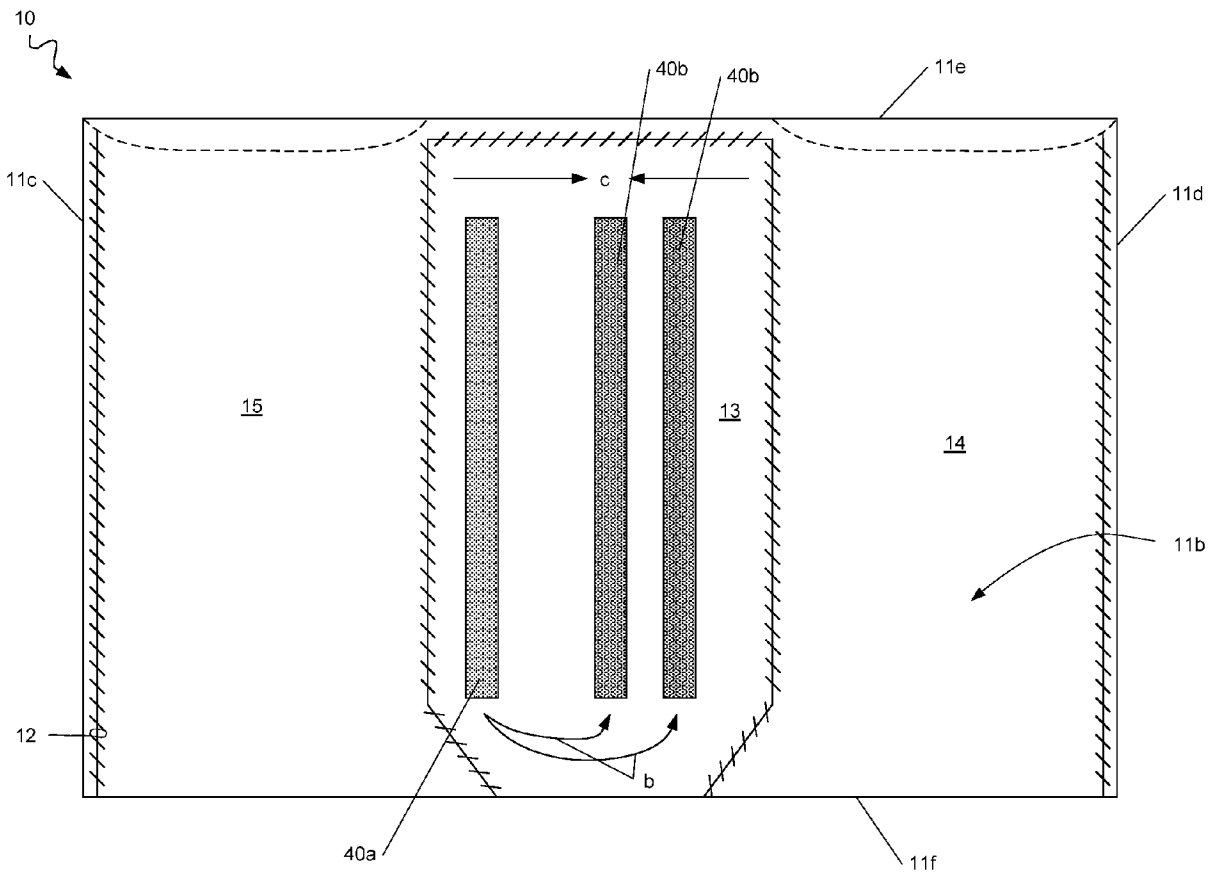
FIG. 4 is a back side view of the recliner and travel pillow, in accordance with one embodiment of the present invention.

FIG. 4 illustrates one embodiment of the recliner and travel pillow 10 described above, that further includes an adjustment unit defined by a plurality of elongated strips of hook and loop material 40*a*, and 40*b* that are disposed along the back side of the main body 11*b* at the central portion 13. As shown by arrow b, the strips can be selectively engaged so as to allow a user to adjust the width of the middle section 13, thereby reducing the distance between pocket areas 14 and 15 (See arrow C). Such a feature can be advantageous for allowing a user to customize the amount of space that will exist between the side of their head and the protruding pillows housed within sections 14 and 15.

Figure 5:
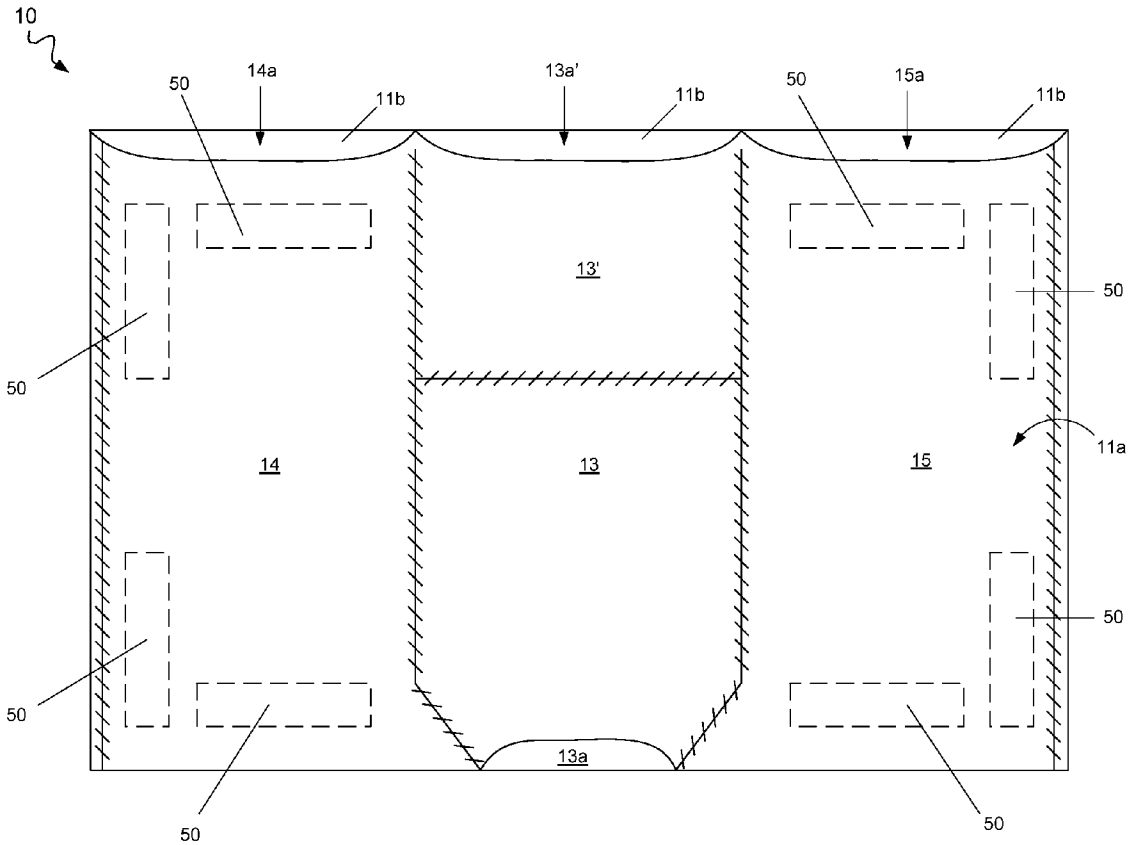
FIG. 5 is a front side view of the recliner and travel pillow, in accordance with another embodiment of the present invention.

FIG. 5 illustrates another embodiment of the pillow 10, that further includes the ability to seal and/or adjust the size of the pocket areas 14 and 15, utilizing one or more pocket connectors 50. In one embodiment, each pocket connector 50 can also include opposing strips of hook and loop material (e.g., Velcro®) that are secured to both the front surface 11*a* and back surface 11*b* within each of the pocket areas 14 and 15. When so engaged, the pocket connectors can form a temporary seam.

As shown, when the connectors 50 are disposed along the top edge 11*b* of the pockets, the connectors can function to temporarily seal the openings 14*a* and 15*a* into a closed position, so as to prevent a pillow insert 20 from falling out during use. Additionally, when positioned parallel to the seams 12 and the bottom edge 11*f*, these seam connectors can function to reduce the height and/or length of each of the pocket areas 14 and 15, respectively that is available to receive a pillow insert. Such a feature can be beneficial to allow the main body to receive pillow inserts of varying sizes, and/or to allow a user to fold a pillow insert in half, so as to increase the amount the pillow will protrude from the main body.

As further shown in FIG. 5, the main body can further include a therapy pocket 13*a*' defined by seams 12 and an opening 13*a*' and an additional adjustable pocket 13*a* defined by seams 12 and an opening 13*a*. Pocket 13*a*' can preferably be small in nature and capable of receiving any number of rejuvenating instruments, such as a heat pack, cool pack and/or an aromatherapy pack, for example. Pocket 13*a* can preferably be small in nature and capable of receiving a variety of sized and shaped pillows or rejuvenating instruments as previously described herein and can allow for adjustable neck positions.

Although described above as utilizing hook and loop material, those of skill in the art will recognize that the adjustment unit and/or the pocket connectors 50 can also include any number of known components capable of creating a temporary seam between two objects. Several non-limiting examples include opposing polarity magnets and/or magnetic elements, as well as compression fittings such as snaps and buttons, for example. Each of these items can be permanently secured to the main body 11 by a permanent sealer such as glue, adhesive tape, or stitching, for example.

Figure 6:
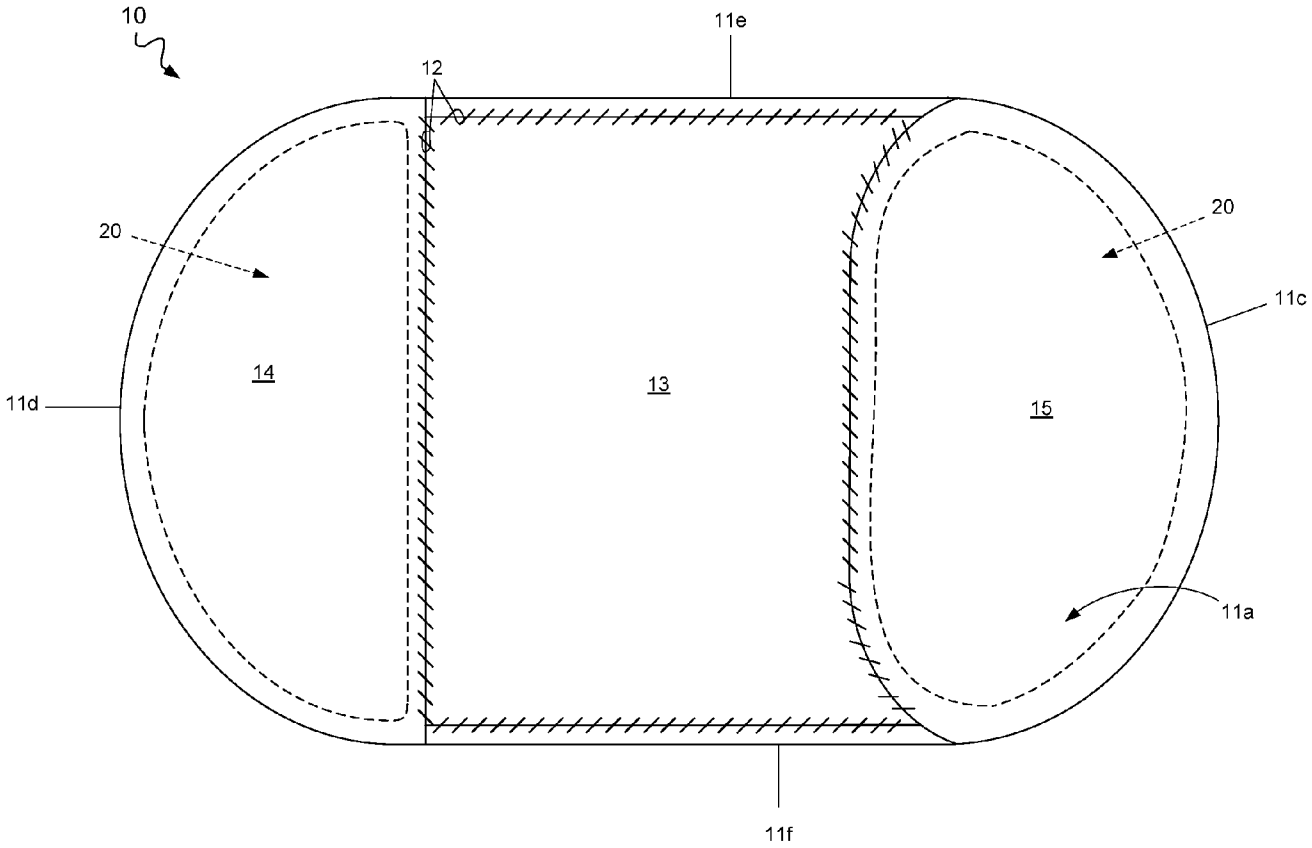
FIG. 6 is a front side view of the recliner and travel pillow, in accordance with yet another embodiment of the present invention.

Although illustrated as including a generally rectangular shaped main body 11, with identical shaped and sized pockets 14 and 15, this is for illustrative purposes only, as those of skill in the art will recognize that any number of different shapes can be utilized herein without limitation. To this end, FIG. 6 illustrates another embodiment of the pillow 10 wherein the main body 11, pockets 14 and 15, and pillow inserts 20 include different shapes and dimensions.

As described herein, one or more elements of the recliner and travel pillow 10 can be secured together utilizing any number of known attachment means such as, for example, stitching, hem tape and/or liquid sealants, among others. Moreover, although the above embodiments have been described as including separate individual elements, the inventive concepts disclosed herein are not so limiting. To this end, one of skill in the art will recognize that one or more individual elements such as the main body 11 and one or more of the removable pillow inserts 20 can be permanently secured together at a time of manufacture (see FIG. 6), thereby removing the need to include the pocket openings 14*a* and 15*a*, respectively. Such a feature can be beneficial for allowing a lower cost version of the pillow to be produced, while maintaining the ability to provide proper head and neck alignment without pushing the back of the users head away from a chair or recliner.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A pillow, comprising:

a unitary main body having a front surface, a rear surface, a first and second side edges, a bottom edge and a top edge;

a first pocket disposed within the main body at a location adjacent to the first side edge, said pocket further including an opening positioned along the front surface at a location adjacent to the top edge;

a second pocket disposed within the main body at a location adjacent to the second side edge, said second pocket further including an opening positioned along the front surface at a location adjacent to the top edge;

said main body including a flat non-pocketed central portion that is defined by the first pocket, the second pocket, the top edge and the bottom edge, and further including a permanent seam along the top edge that extends from the first pocket to the second pocket;

a pair of removable pillow inserts each having a shape and dimension that is complementary to a shape and dimension of at least one of the first and second pockets; and at least one seam connector disposed within each of the first and second pockets at a location adjacent to at least one of the first and second side edges, the flat central portion, and the bottom edge, said seem connectors being configured to selectively reduce at least one of a height and length of the pocket when engaged.

2. The pillow of claim 1, wherein the first and second pockets include identical shapes and dimensions.

3. The pillow of claim 1, wherein the first pocket includes a shape that is not identical to the shape of the second pocket.

4. The pillow of claim 1, wherein each of the pillow inserts are constructed from a material that is machine washable.

5. The pillow of claim 1, further comprising an adjustment unit that is configured to adjust a width of the flat non-pocketed central portion, said adjustment unit including:

a first elongated connector that is disposed along the rear surface of the flat non-pocketed central portion of the main body, at a location adjacent to the first pocket;

a second elongated connector that is disposed along the rear surface of the flat non-pocketed central portion of the main body, at a location adjacent to the second pocket; and a third elongated connector that is disposed along the rear surface of the flat non-pocketed central portion of the main body, at a location that is between the first and second elongated connectors, each of the first, second and third elongated connectors extending from the top edge of the main body to the bottom edge of the main body; and said first elongated connector being configured to selectively engage one of the second elongated connector and the third elongated connector.

6. The pillow of claim 1, further comprising:

at least one connector disposed within the first and second pockets at a location adjacent to the pocket openings, said connectors being configured to secure the pocket in a closed position when engaged.

7. The pillow of claim 6, wherein each of the connectors include at least one of a pair of opposing strips of hook and loop material, a pair of magnetic elements, and a pair of compression fittings.

8. The pillow of claim 1, wherein each of the seam connectors include at least one of a pair of opposing strips of hook and loop material, a pair of magnetic elements, and a pair of compression fittings.

9. The pillow of claim 1, wherein the flat central portion extends across the entirety of a distance between the top edge and the bottom edge of the main body.

10. A pillow, comprising:

a unitary main body having a front surface, a rear surface, a first and second side edges, a bottom edge and a top edge;

a permanently sealed first pocket disposed within the main body at a location adjacent to the first side edge;

a permanently sealed second pocket disposed within the main body at a location adjacent to the second side edge;

said main body including a flat non-pocketed central portion that is defined by the first pocket, the second pocket, the top edge and the bottom edge, and further including a permanent seam along the top edge that extends from the first pocket to the second pocket;

a pair of pillow inserts disposed within the first and second sealed pockets; and at least one seam connector disposed within each of the first and second pockets at a location adjacent to at least one of the first and second side edges, the flat central portion, and the bottom edge, said seem connectors being configured to selectively reduce at least one of a height and length of the pocket when engaged.

11. The pillow of claim 10, wherein the first and second pockets include identical shapes and dimensions.

12. The pillow of claim 10, wherein the first pocket includes a shape that is not identical to the shape of the second pocket.

13. The pillow of claim 10, further comprising an adjustment unit that is configured to adjust a width of the flat non-pocketed central portion, said adjustment unit including:

a first elongated connector that is disposed along the rear surface of the flat non-pocketed central portion of the main body, at a location adjacent to the first pocket;

a second elongated connector that is disposed along the rear surface of the flat non-pocketed central portion of the main body, at a location adjacent to the second pocket; and a third elongated connector that is disposed along the rear surface of the flat non-pocketed central portion of the main body, at a location that is between the first and second elongated connectors, each of the first, second and third elongated connectors extending from the top edge of the main body to the bottom edge of the main body; and said first elongated connector being configured to selectively engage one of the second elongated connector and the third elongated connector.

14. The pillow of claim 10, wherein the flat central portion extends across the entirety of a distance between the top edge and the bottom edge of the main body.

15. The pillow of claim 5, wherein each of the first, second and third elongated connectors consist of one or more magnetic elements.

16. A pillow, comprising:

a unitary main body having a front surface, a rear surface, a first and second side edges, a bottom edge and a top edge;

a first pocket disposed within the main body at a location adjacent to the first side edge, said pocket further including an opening positioned along the front surface at a location adjacent to the top edge;

a second pocket disposed within the main body at a location adjacent to the second side edge, said second pocket further including an opening positioned along the front surface at a location adjacent to the top edge;

a pair of removable pillow inserts each having a shape and dimension that is complementary to a shape and dimension of at least one of the first and second pockets;

said main body including a flat central portion that is defined by the first pocket, the second pocket, the top edge and the bottom edge, said flat central portion consisting of:

a permanent seam that extends from the first pocket to the second pocket along a middle section of the flat central portion, a therapy pocket that is disposed along the main body at a location within the flat central portion, and being defined by the top edge, the first pocket, the second pocket and the permanent seam, said therapy pocket including an opening along the top edge, and an adjustable neck position pocket that is disposed along the main body at a location within the flat central portion, and being defined by the bottom edge, the first pocket, the second pocket and the permanent seam, said adjustable neck position pocket including an opening along the bottom edge; and at least one seam connector disposed within each of the first and second pockets at a location adjacent to at least one of the first and second side edges, the flat central portion, and the bottom edge, said seem connectors being configured to selectively reduce at least one of a height and length of the pocket when engaged.

17. The pillow of claim 16, wherein said therapy pocket includes a shape and dimension that is configured to receive at least one of a heat pack, a cool pack and an aromatherapy pack.

18. The pillow of claim 16, wherein said adjustable neck position pocket includes a shape and dimension that is configured to receive at least one of a heat pack, a cool pack and an aromatherapy pack.

19. The pillow of claim 16, further comprising an adjustment unit that is configured to adjust a width of the flat non-pocketed central portion, said adjustment unit including:

a first elongated connector that is disposed along the rear surface of the flat non-pocketed central portion of the main body, at a location adjacent to the first pocket;

a second elongated connector that is disposed along the rear surface of the flat non-pocketed central portion of the main body, at a location adjacent to the second pocket; and a third elongated connector that is disposed along the rear surface of the flat non-pocketed central portion of the main body, at a location that is between the first and second elongated connectors, each of the first, second and third elongated connectors extending from the top edge of the main body to the bottom edge of the main body; and said first elongated connector being configured to selectively engage one of the second elongated connector and the third elongated connector.

* * * * *